US008240315B2

(12) United States Patent
Olegario et al.

(10) Patent No.: US 8,240,315 B2
(45) Date of Patent: Aug. 14, 2012

(54) SMOKING ARTICLE WITH IMPROVED DELIVERY PROFILE

(75) Inventors: Raquel M. Olegario, Richmond, VA (US); Mike Braunshteyn, Richmond, VA (US); Gail Yoss, Chesterfield, VA (US); Jim Lyons-Hart, Sandston, VA (US)

(73) Assignee: Philip Morris USA Inc., Richmond, VA (US)

( * ) Notice: Subject to any disclaimer, the term of this patent is extended or adjusted under 35 U.S.C. 154(b) by 932 days.

(21) Appl. No.: 11/641,673

(22) Filed: Dec. 20, 2006

(65) Prior Publication Data

US 2007/0186945 A1 Aug. 16, 2007

Related U.S. Application Data

(60) Provisional application No. 60/754,277, filed on Dec. 29, 2005.

(51) Int. Cl.
*A24D 1/04* (2006.01)

(52) U.S. Cl. ..... 131/362; 131/361; 131/338; 131/280; 131/334; 131/335; 131/344; 131/345

(58) Field of Classification Search ..... 131/361, 131/338, 280
See application file for complete search history.

(56) References Cited

U.S. PATENT DOCUMENTS

| | | | |
|---|---|---|---|
| 2,592,553 | A | 4/1952 | Frankenburg et al. |
| 2,592,554 | A | 4/1952 | Frankenburg |
| 2,598,680 | A | 6/1952 | Frankenburg |
| 2,769,734 | A | 11/1956 | Bandel |
| 2,954,772 | A | 10/1960 | Lebert |
| 2,954,778 | A | 10/1960 | Lebert |
| 2,954,783 | A | 10/1960 | Lebert |
| 2,954,786 | A | 10/1960 | Lebert |
| 3,098,492 | A | 7/1963 | Wurzburg et al. |
| 3,236,244 | A | 2/1966 | Irby, Jr. et al. |
| 3,255,760 | A | 6/1966 | Selke |
| 3,283,762 | A | 11/1966 | Kissel |
| 3,318,312 | A | 5/1967 | Curtis, Jr. |
| 3,356,094 | A | 12/1967 | Ellis et al. |
| 3,395,713 | A | 8/1968 | Ent-Keller |
| 3,457,927 | A | 7/1969 | Siragusa |
| 3,496,945 | A | 2/1970 | Tomkin |

(Continued)

FOREIGN PATENT DOCUMENTS

BE 679657 A 10/1966

(Continued)

OTHER PUBLICATIONS

Written Opinion dated Aug. 5, 2004 for International Application No. PCT/US04/04530.

(Continued)

*Primary Examiner* — Yogendra Gupta
*Assistant Examiner* — Margaret Squalls
(74) *Attorney, Agent, or Firm* — Buchanan Ingersoll & Rooney PC

(57) ABSTRACT

A smoking article, which provides lower amounts of total particulate matter in a latter portion of its puff count, includes a cylinder of smoking material, a combustible hollow tube within the cylinder of smoking material, and a heat sink at a downstream end of the hollow tube. The smoking article also includes a filter system attached to the cylinder of smoking material having a sorbent material and at least one downstream segment of filtering material.

14 Claims, 5 Drawing Sheets

U.S. PATENT DOCUMENTS 3,581,748 A 6/1971 Cameron
3,637,447 A 1/1972 Berger et al.
3,648,712 A 3/1972 Patterson
3,685,522 A 8/1972 Kleinhans
3,738,375 A 6/1973 Doumas
3,756,249 A 9/1973 Selke et al.
3,759,270 A 9/1973 Wright
3,860,011 A 1/1975 Norman
3,931,824 A 1/1976 Miano et al.
3,968,804 A 7/1976 Kelly et al.
3,986,515 A 10/1976 Egri
4,016,887 A 4/1977 Uroshevich
4,022,222 A 5/1977 Berger
4,091,821 A 5/1978 Scorzo
4,119,105 A 10/1978 Owens, Jr.
4,120,310 A 10/1978 Lee et al.
4,135,523 A 1/1979 Luke et al.
4,182,349 A 1/1980 Selke
4,186,756 A 2/1980 Takemoto et al.
4,197,863 A 4/1980 Clayton et al.
4,256,122 A 3/1981 Johnson
4,256,126 A 3/1981 Seligman et al.
4,273,141 A 6/1981 Van Tilburg
4,292,983 A 10/1981 Mensik
4,340,072 A 7/1982 Bolt et al.
4,341,228 A 7/1982 Keritsis et al.
4,357,950 A 11/1982 Berger
4,380,241 A 4/1983 Horsewell
4,386,618 A 6/1983 Cantrell
4,421,126 A 12/1983 Gellatly
4,460,001 A 7/1984 Browne et al.
4,469,112 A 9/1984 Browne et al.
4,508,525 A 4/1985 Berger
4,515,170 A 5/1985 Cantrell et al.
4,542,755 A 9/1985 Selke et al.
4,564,030 A 1/1986 Jessup et al.
4,574,820 A 3/1986 Pinkerton et al.
4,585,015 A 4/1986 Silberstein
4,622,982 A 11/1986 Gaisch et al.
4,637,409 A 1/1987 Berger
4,649,944 A 3/1987 Houck, Jr. et al.
4,660,579 A 4/1987 Horsewell et al.
4,677,992 A 7/1987 Bliznak
4,687,008 A 8/1987 Houck, Jr. et al.
4,700,726 A 10/1987 Townsend et al.
4,732,168 A 3/1988 Resce et al.
4,754,766 A 7/1988 Luke et al.
4,784,632 A 11/1988 Berger
4,793,365 A * 12/1988 Sensabaugh et al. ..... 131/194
4,867,182 A 9/1989 Roberts et al.
4,896,682 A 1/1990 Liew
4,924,886 A 5/1990 Litzinger
4,942,887 A 7/1990 Abdelgawad et al.
4,962,774 A 10/1990 Thomasson et al.
4,972,853 A 11/1990 Brackmann et al.
4,972,854 A 11/1990 Kiernan et al.
4,984,588 A 1/1991 Stewart, Jr.
5,046,514 A 9/1991 Bolt
5,050,621 A 9/1991 Creighton et al.
5,058,608 A 10/1991 Henning et al.
5,060,676 A 10/1991 Hearn et al.
5,074,319 A 12/1991 White et al.
5,099,864 A 3/1992 Young et al.
5,101,839 A 4/1992 Jakob et al.
5,105,836 A 4/1992 Gentry et al.
5,105,838 A 4/1992 White et al.
5,129,408 A 7/1992 Jakob et al.
5,178,166 A 1/1993 Newsome et al.
5,190,061 A 3/1993 Brackmann et al.
5,203,354 A 4/1993 Hickle
5,360,023 A 11/1994 Blakley et al.
5,392,792 A 2/1995 Banerjee et al.
5,392,793 A 2/1995 Molloy
5,435,326 A 7/1995 Gentry et al.
5,458,107 A 10/1995 Balogh et al.
5,524,647 A 6/1996 Brackmann
5,533,530 A 7/1996 Young et al.
5,568,819 A 10/1996 Gentry et al.
5,584,306 A 12/1996 Beauman et al.
5,598,868 A 2/1997 Jakob et al.
5,666,976 A 9/1997 Adams et al.
5,690,127 A 11/1997 Chapman et al.
5,709,227 A 1/1998 Arzonico et al.
5,715,844 A 2/1998 Young et al.
5,724,998 A 3/1998 Gellatly et al.
5,727,571 A * 3/1998 Meiring et al. ..... 131/194
5,743,251 A 4/1998 Howell et al.
5,746,230 A 5/1998 Arterbery et al.
5,839,449 A 11/1998 Banerjee et al.
5,954,061 A 9/1999 Cardarelli
6,089,238 A 7/2000 Schneider et al.
6,216,706 B1 4/2001 Kumar et al.
6,257,242 B1 7/2001 Stavridis
6,584,979 B2 7/2003 Xue et al.
6,718,989 B1 4/2004 Clarke et al.
6,761,174 B2 7/2004 Jupe et al.
6,779,529 B2 8/2004 Figlar et al.
6,814,786 B1 11/2004 Zhuang et al.
6,823,873 B2 11/2004 Nichols et al.
6,883,516 B2 4/2005 Hindle et al.
6,883,523 B2 4/2005 Dante
2002/0166561 A1 11/2002 Sinclair, Jr.
2003/0200973 A1 10/2003 Xue et al.
2003/0200976 A1 10/2003 Yoo
2004/0025890 A1 2/2004 Yen
2004/0159327 A1 * 8/2004 Dante ..... 131/337
2004/0261807 A1 12/2004 Dube et al.
2005/0066980 A1 3/2005 Crooks et al.
2005/0066981 A1 3/2005 Crooks et al.
2006/0201524 A1 9/2006 Zhang et al.
2007/0169785 A1 7/2007 Gedevanishvili et al.
2007/0181140 A1 8/2007 Xue et al.
2007/0186945 A1 8/2007 Olegario et al.
2007/0235050 A1 10/2007 Li et al.
2007/0261706 A1 11/2007 Banerjea et al.
2008/0017204 A1 1/2008 Braunshteyn et al.
2008/0047571 A1 2/2008 Braunshteyn et al.
2008/0163877 A1 7/2008 Zhuang et al.
2008/0216848 A1 9/2008 Li et al.
2008/0216851 A1 9/2008 Olegario et al.

FOREIGN PATENT DOCUMENTS

BE 1000454 A4 12/1988
DE 3439861 A1 5/1985
EP 0077123 A2 4/1983
EP 0212879 A1 3/1987
EP 0364256 A1 4/1990
EP 0471 581 A1 2/1992
EP 471581 A1 * 2/1992
EP 0482 872 A1 4/1992
EP 482872 A1 * 4/1992
EP 0568107 A 11/1993
EP 0481596 B1 1/1994
FR 2481581 11/1981
GB 1058342 A 2/1967
GB 1228747 4/1971
GB 1256154 12/1971
GB 1428018 3/1976
GB 2100573 A 1/1983
GB 2149287 A 6/1985
GB 2149287 A * 6/1985
GB 2177890 A 2/1987
WO WO 90/09741 A 9/1990
WO WO 99/26495 A 6/1999
WO WO00/00047 1/2000
WO WO 02/03819 A 1/2002
WO WO 2006/070289 A 7/2006
WO WO2006082529 A 8/2006
WO WO2007/093757 A1 8/2007
WO WO2007/110650 A1 10/2007

OTHER PUBLICATIONS

International Search Report dated Aug. 5, 2004 for PCT/US04/04530.

International Search Report dated Oct. 19, 2007 for International Application No. PCT/IB2006/004202.

Written Opinion dated Oct. 19, 2007for International Application No. PCT/IB2006/004202.
Invitation to Pay Additional Fees and Annex to Form PCT/ISA/206 Communication Relating to the Results of the Partial International Search dated Oct. 16, 2007 for International Application No. PCT/IB2006/004209.
International Search Report and Written Opinion dated Mar. 17, 2008 for PCT/IB2006/004209.
International Preliminary Report on Patentability dated Jul. 10, 2008 for PCT/IB2006/004202.
International Search Report and Written Opinion dated Sep. 19, 2008 for PCT/IB2007/004503.
International Preliminary Report on Patentability dated Jul. 10, 2008 for PCT/IB2006/004209.
International Preliminary Report on Patentability mailed Jul. 9, 2009 for PCT/IB2007/004503.
International Preliminary Report on Patentability mailed Sep. 24, 2009 for International Application No. PCT/IB2008/001372.
International Search Report and Written Opinion dated Nov. 3, 2008 for PCT/IB2008/001372.
International Preliminary Report on Patentability for PCT/IB2007/004224 dated May 19, 2009.
International Preliminary Report on Patentability for PCT/GB2007/001144 dated Sep. 30, 2008.
International Search Report and Written Opinion for PCT/IB2007/004224 dated Jun. 13, 2008.
International Search Report and Written Opinion for PCT/GB2007/00114 dated Jul. 7, 2007.
International Preliminary Report on Patentability mailed Sep. 15, 2009 for PCT/IB2008/001383.
International Search Report and Written Opinion mailed Feb. 24, 2009 for PCT/IB2008/001383.
Partial International Search Report mailed Nov. 11, 2008 for PCT/IB2008/001383.
International Preliminary Report on Patentability issued Jan. 13, 2009 for PCT/IB2007/002869.
International Search Report and Written Opinion dated Jan. 25, 2008 for PCT/IB2007/002869.
International Preliminary Report on Patentability issued Jan. 13, 2009 for PCT/IB2007/002910.

* cited by examiner

SMOKING ARTICLE WITH IMPROVED DELIVERY PROFILE

CROSS-REFERENCE TO RELATED APPLICATION

This application claims priority to U.S. Patent Provisional Application No. 60/754,277, filed Dec. 29, 2005, which is incorporated herein by this reference in its entirety.

BACKGROUND

Smoking articles, particularly cigarettes, generally comprise a tobacco rod of shredded tobacco (also referred to as cut filler) surrounded by a paper wrapper, and a cylindrical filter aligned in an end-to-end relationship with the tobacco rod. The tobacco rod is generally about 6.0 and 10.0 millimeters in diameter and 40 millimeters and 125 millimeters in length. Typically, the filter includes a segment of cellulose acetate tow attached to the tobacco rod by tipping paper. Ventilation of mainstream smoke can be achieved with a row or rows of perforations about a location along the filter.

In a conventional cigarette, the total particulate matter (TPM) per puff increases as one progresses along the puff count, i.e. the last puff may deliver twice as much TPM than the first puff. It is believed that the increase occurs because (a) as the tobacco column is consumed, the filtration caused by the tobacco shreds decreases and (b) the TPM that condenses on the shredded tobacco from earlier puffs is vaporized and combusted as the tobacco rod is consumed in subsequent puffs.

SUMMARY

Accordingly, it would be desirable to provide a smoking article such that the per-puff delivery levels do not significantly increase as smoking progresses from the first several puffs to the latter several puffs. With a more consistent or reduced per puff delivery in the latter portion of the puff count, the smoking article may be designed according to a predetermined overall level of delivery (e.g., FTC tar), with a larger proportion of the overall delivery originating from the earlier (initial) puffs. Consequently, the smoking article can be made to taste stronger (at least initially) without increasing overall delivery (FTC tar) and/or one can provide a smoking article of a given delivery level (FTC tar) that is more likely to be organoleptically acceptable to smokers having a preference for smoking articles of a higher overall delivery (FTC tar).

In accordance with one embodiment, a smoking article comprises: a cylinder of smoking material; a hollow tube within the cylinder of smoking material; a heat sink at a downstream end of the hollow tube; and a filter system attached to the cylinder of smoking material, the filtering system comprising a sorbent material and at least one downstream segment of filtering material.

In accordance with a further embodiment, a smoking article comprises: a cylinder of smoking material; a hollow tube within the cylinder of smoking material and having a heat sink at a downstream end thereof; and a filter system attached to the cylinder of smoking material, the filtering system comprising a substrate containing an aerosol former.

In accordance with another embodiment, a smoking article comprises: a tobacco rod ignitable to form a coal; a filter in cooperative relation with said tobacco rod; said tobacco rod comprising: a fully filled rod portion adjacent a free end of said tobacco rod; and a hollow, partially filled, rod portion located between said free end and said filter; such that tar delivery per puff is reduced as a coal progresses from said fully filled rod portion into said hollow, partially filled, rod portion.

In accordance with a further embodiment, a method of making a smoking article, comprises: forming a tobacco rod portion of the smoking article by placing smoking material between a hollow tube and an outer layer of wrapper paper; forming a filter portion of the smoking article having a plurality of segments with at least one of said segments comprising a substrate containing an aerosol former that activates when exposed to thermal energy; and joining said tobacco rod portion in end-to-end relationship with the filter system such that said tube provides at least a portion of a passageway from one end of said smoking article to said at least one segment of the filter portion comprising the aerosol former.

In accordance with another embodiment, a method of generating from a smoking article a smoke of enhanced perceived strength by altering its puff count profile to have stronger per puff delivery along one or more first puffs by spacing a hollow tobacco rod portion in a spaced relation away from a fully filled tip portion of the tobacco rod.

DETAILED DESCRIPTION

Figure 1:
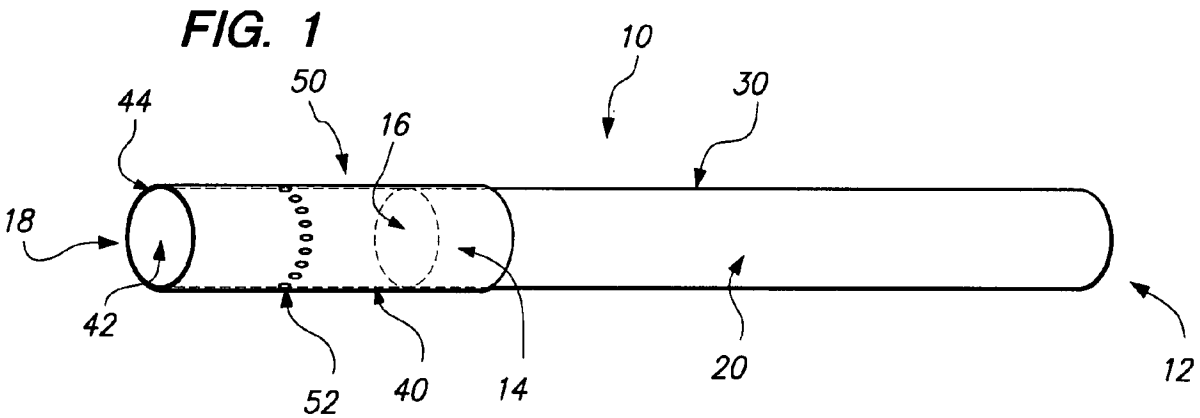
FIG. 1 shows a perspective view of a smoking article according to one embodiment having a tobacco rod with a concentric hollow tube.

FIG. 1 shows a smoking article 10 in the form of a cigarette. Smoking articles 10 in the form of cigarettes, typically include, a generally cylindrical rod 20 of smoking material 21 (FIG. 2), contained in a circumscribing outer wrapper 30. The outer wrapper 30 is typically a porous wrapping material or paper wrapper. The rod 20 is typically referred to as a "tobacco rod" and has a lit end 12 and a tipped end 14. The smoking material 21 is preferably a shredded tobacco (tobacco cut filler). However, any suitable smoking material 21 can be used.

The smoking article 10 also includes a filter system (or filter) 40 adjacent to the tipped end 14 of the tobacco rod 20 such that the filter system 40 and tobacco rod 20 are axially aligned in an end-to-end relationship, preferably abutting one another. The filter system 40 has a generally cylindrical shape, and the diameter thereof is essentially equal to the diameter of the tobacco rod 20. The ends (i.e., upstream end 16 and downstream end 18) of the filter system 40 permit the passage of air and smoke therethrough.

The filter system 40 preferably includes a plurality of filter materials 42 preferably circumscribed by a segment wrap 44. The segment wrap 44 is a paper which optionally incorporates a carbonaceous material. The segment wrap 44 preferably circumscribes the total length of the filter system 40. The filter system 40 is attached to the tobacco rod 20 by a tipping material 50, which circumscribes both the entire length of the filter system 40 and an adjacent region of the tobacco rod 20. The tipping material 50 is typically a paper like product; however, any suitable material can be used. The inner surface of the tipping material 50 is fixedly secured to the outer surface of the segment wrap 44 and the outer surface of the wrapping material 30 of the tobacco rod 20, using a suitable adhesive. A ventilated or air diluted smoking article 10 can be provided with an air dilution means, such as a series of ventilation holes or perforations 52, each of which extend through the tipping material 50 and optionally the segment wrap 44.

Figure 2:
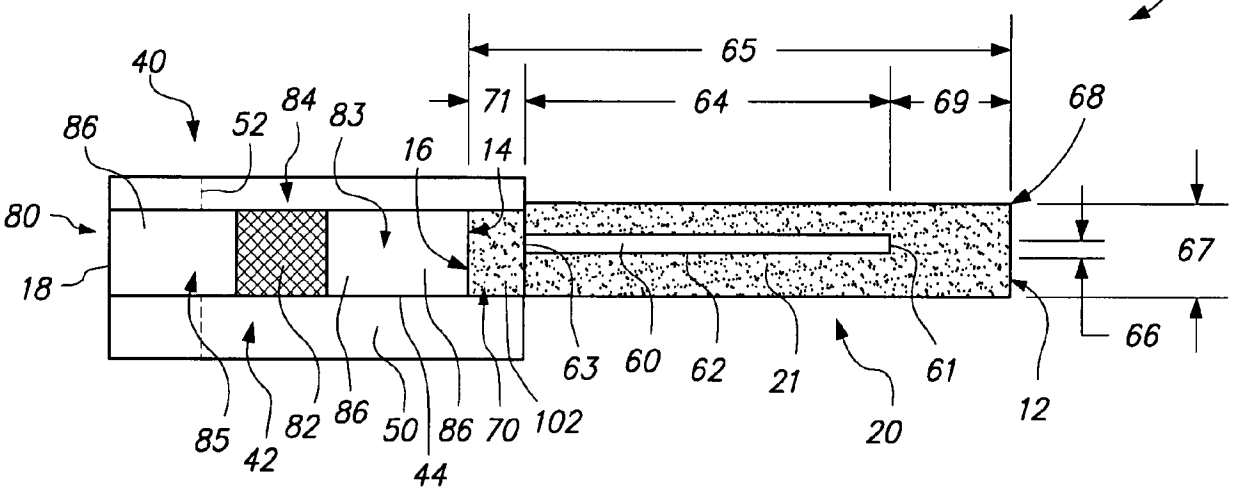
FIG. 2 shows a cross sectional view of a smoking article having a tobacco rod with a concentric hollow tube and a tipping material, which has been partially unfolded to reveal the filter assembly.

FIG. 2 shows a cross sectional view of a smoking article 10 having a tobacco rod 20 with a concentric hollow tube (or passage) 60. The concentric hollow tube 60 can be incorporated into the tobacco rod 20 of the smoking article 10, in such a way that the tube 60 can alter the usual total particulate matter (TPM) delivery profile of a conventional cigarette or smoking article 10. The tobacco rod 20 is comprised of a hollow tube 60, surrounded by a smoking material 21, such as a tobacco filler material, and an outer layer of cigarette wrapper (paper) 30 (FIG. 1). The hollow tube 60 is preferably centrally or concentrically located within the cylindrical rod 20 of smoking material 21, and having a first or upstream end 61 proximate to but spaced apart from the lit end 12 of the tobacco rod 20, and a second or downstream end 63 proximate to the tipped end 14 of the tobacco rod 20. As shown in FIG. 2, the hollow tube 60 preferably extends from the tipped end 14 of the tobacco rod 20 towards the lit end 12 of the tobacco rod 20 with an overall length 64 of about 20 to 100 millimeters. The internal or inner diameter 66 of the hollow tube 60 can vary from about 0.5 and 5.5 millimeters, and is preferably about 1.5 to 3.5 millimeters, and more preferably about 2.0 to 3.0 millimeters for a tobacco rod 20 with an outer diameter 67 of about 6.0 and 10.0 millimeters and an overall length 65 of about 40.0 to 125.0 millimeters. It can be appreciated that one or more non-concentric hollow tubes 60 also can be used.

During smoking, the delivery profile of the smoking article 10 including the amount of tar per puff will generally be determined by the length 64 and the inner diameter 66 of the hollow tube 60, as well as the hollow tube's 60 position within the tobacco rod 20. Furthermore, depending on the length 64 and internal diameter 66 of the hollow tube 60, the delivery profile for the smoking article 10 can in fact be reversed, i.e., the initial puffs can deliver up to 6 times more TPM than the last puff.

As shown in FIG. 2, the lit end 12 of the tobacco rod 20 can include a tip (or end portion) 68, which is fully filled with a smoking material 21, and which extends from the lit end 12 of the smoking article 10 to the first or upstream end 61 of the hollow tube 60 and preferably has an overall length 69 of about 2.0 to 30.0 millimeters. The fully filled tip 68 of smoking material 21 provides the smoking article 10 with a higher delivery rate during the initial puffs than in subsequent puffs when the coal has arrived at the hollow tube 60. Furthermore, it can be appreciated that the length 69 of the fully filled tip 68 of smoking material 21 can vary depending on the length 65 of the tobacco rod 20 and the desired delivery profile. The second or downstream end 63 of the hollow tube 60 is positioned on the tipped end 14 of the tobacco rod 20 and includes a heat sink 70. The heat sink 70 is configured to dissipate the thermal energy transferred from the burning tobacco material 21 (i.e., coal) by the hollow tube 60. As shown in FIG. 2, the heat sink 70 can be a blended tobacco segment having the same or different character as the smoking material 21 of the tobacco rod 20. Alternatively, the heat sink 70 can be any suitable material including but not limited to tobacco pellets, a low density porous ceramic segment containing added flavors, diluents or other suitable materials. The heat sink 70 preferably has an overall length 71 of about 5.0 to 20.0 millimeters. The heat sink 70 may also be constructed as part of the filter system 40.

During smoking, the configuration of the tobacco rod 20 provides the smoking article 10 with a delivery profile having a higher tar delivery in the initial puffs (i.e., puffs 1 through 4 along the fully filled rod portion 68) and a reduced or lower tar delivery in the subsequent puffs (i.e., puffs 5 through 8 along the hollow rod portion defined by the tube (passage) 60). In addition, by varying the length 64 of the hollow tube 60 and the hollow tube's 60 relative position within the tobacco rod 20, including the distance from the lit end 12 of the smoking article 10 to the first or upstream end 61 of the hollow tube 60, subsequent puffs (i.e., 5 and greater) can also have a higher tar delivery. Also, by varying the length 64 of the hollow tube 60 and the relative position of the hollow tube 60 within the tobacco rod 20, subsequent puffs after a desired number of puffs can have a reduced or lower tar delivery profile. The reduced or lower tar delivery profile occurs as a result of the smoke traveling preferentially down the hollow tube 60 (i.e., the path of least resistance). Furthermore, the filtration effect provided by the tobacco rod 20 occurs for only a short distance of the overall length of the tobacco rod 20 and that distance decreases from an initial puff (i.e., $1^{st}$ puff) to subsequent puffs thereafter (i.e., $4^{th}$ puff). Therefore, while the char line is at the fully filled tip 68, it can be appreciated that a smoking article 10 having a hollow tube 60 can deliver more TPM per puff than observed in a conventional cigarette. For example, for subsequent puffs (i.e., from puffs 5 to 8), when the char line reaches the hollow tube 60, the cigarette or smoking article 10 delivers much less TPM per puff due to the effect of the hollow tube 60 allowing more air dilution of mainstream smoke generated by the combustion of the smoking material 21 of the tobacco rod 20 and the hollow tube 60 itself.

Accordingly, there is provided a smoking article such that the per-puff delivery levels do not significantly increase as smoking progresses from the first several puffs to the latter several puffs. With a more consistent or reduced per puff delivery in the latter portion of the puff count, the smoking article may be designed according to a predetermined overall level of delivery (e.g., FTC tar), with a larger proportion of the overall delivery originating from the earlier (initial) puffs. Consequently, the smoking article can be made to taste stronger (at least initially) without increasing overall delivery (FTC tar) and/or one can provide a smoking article of a given delivery level (FTC tar) that is more likely to be organoleptically acceptable to smokers having a preference for smoking articles of a higher overall delivery (FTC tar).

It can be appreciated that the hollow core tube 60 can be constructed in a number of ways, including a blended tobacco cut filler rod, or other combustible materials such as cellulose-based filler, with a hollow center. The walls 62 of the hollow tube 60 can be made out of combustible sheet material such as paper, chemically treated paper, and tobacco-based sheet materials. The sheet materials of the hollow tube 60 can be chemically treated with burn modifiers, ammonium monophosphate, flavorants and aerosol formers. Alternatively, the hollow core or tube 60 of the tobacco rod 20 can be molded, extruded or formed of combustible materials such as blended tobacco or cellulose-based materials using suitable binders such as pectin, starch, and guar gum. In addition, it can be appreciated that the hollow tube 60 can be constructed to collapse upon itself during use or alternatively, constructed in a manner wherein the hollow tube 60 does not collapse upon itself during smoking.

In one embodiment, the filter system 40 has a filter assembly 80 comprising at least one segment of a sorbent material 82 and at least one segment of a filtering material 86. Herein, the "upstream" and "downstream" relative positions between filter segments 42 and other features are described in relation to the direction of mainstream smoke as it is drawn from the hollow tube 60 of the tobacco rod 20 and through the multi-component filter system 40. As shown in FIG. 2, the filter assembly 80 includes at least one segment of a sorbent material 82 in the form of an activated carbon filter. The sorbent material 82 is positioned between a pair of segments (i.e., an upstream and downstream segment 83, 85) of filtering material 86. The filtering material 86 is preferably a cellulose acetate tow filter; however, other suitable filtering materials can be used. A filter system assembly 80 having a sorbent material 82 in the form of an activated carbon segment 82 in a cavity 84 between an upstream segment 83 and a downstream segment 85 of filtering material 86 in the form of cellulose acetate segments is often referred to as a "segment-space-segment" or "plug-space-plug" (PSP) filter configuration. In addition, as shown in FIG. 2, the smoking article 10 can include a series of ventilation holes or perforations 52, each of which extend through the tipping material 50 and the segment wrap 44 and which are preferably located on the downstream side of the sorbent material 82.

The sorbent material 82 can be in the form of granules, carbon-on-tow (i.e., cellulose acetate with an activated carbon mixed throughout) and the like. In one embodiment, the sorbent material 82 is a high surface area, activated carbon, for example, a coconut shell based carbon of typical ASTM mesh size used in the cigarette industry or finer. Alternatively, the sorbent material 82 can be a bed of activated carbon, which is adapted to adsorb constituents of mainstream smoke, particularly, those of the gas phase including aldehydes, ketones and other volatile organic compounds, and in particular 1, 3 butadiene, acrolein, isoprene, propionaldehyde, acrylonitrile, benzene, toluene, styrene, acetaldehyde and/or hydrogen cyanide.

Upon lighting of the smoking article 10, the mainstream smoke is generated by and drawn from the tobacco rod 20 and through the filter system 40. The smoke from a smoking article 10 having a hollow tube 60 can travel down the hollow tube 60 at temperatures as high as 250 degrees C., even at considerable distances from the coal. Accordingly, in an alternative embodiment, the heat sink 70 can be treated with an aerosol former 102, which is released by exposure to thermal energy contained within the filter system 40. The heat sink 70 having an aerosol former 102 also helps prevent the filtering material 86 (typically cellulose acetate) from melting under the heat delivered by the hollow tube 60.

Figure 3:
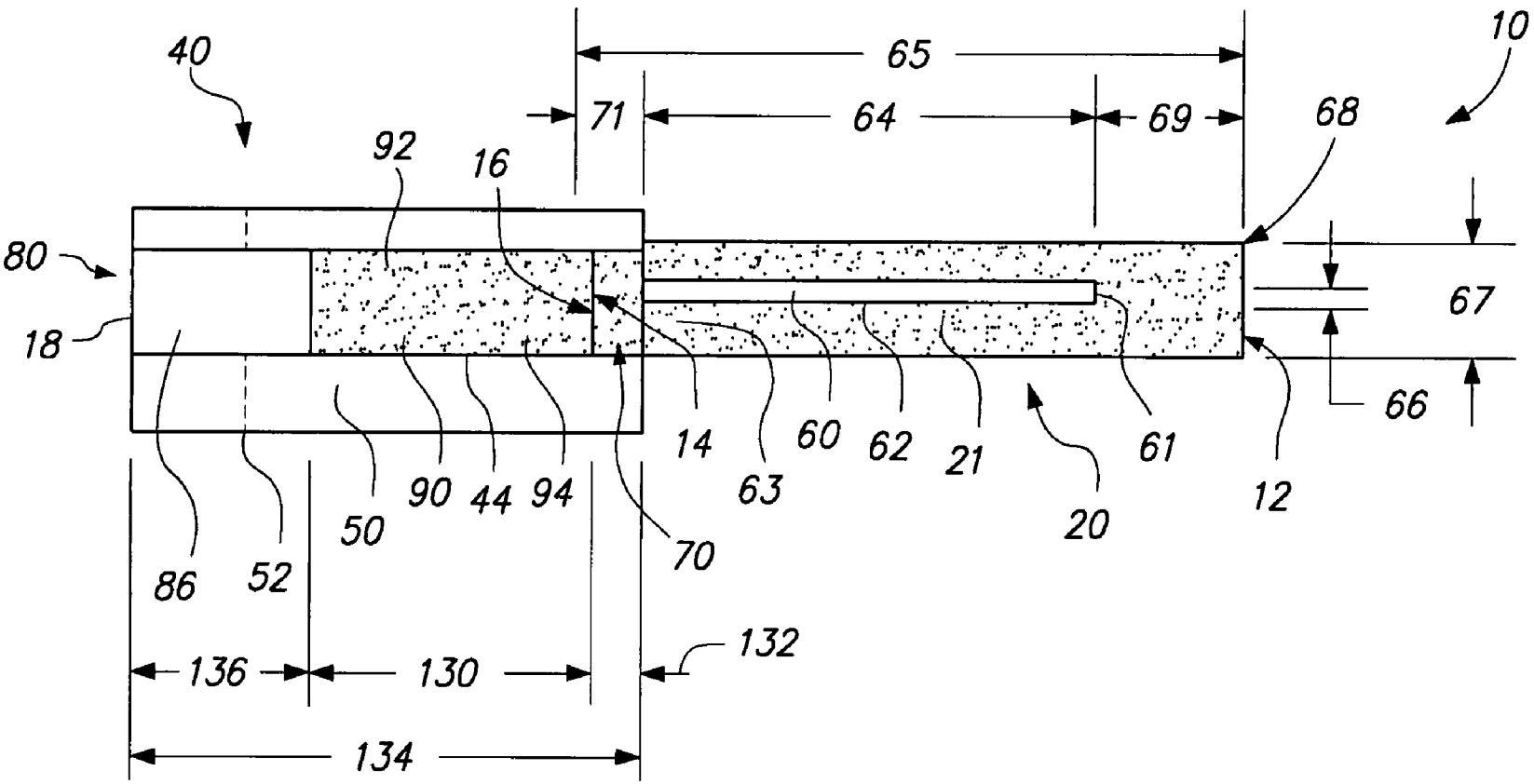
FIG. 3 shows a cross sectional view of another embodiment of a smoking article having a tobacco rod with a concentric hollow tube and a tipping material, which has been partially unfolded to reveal the filter assembly.

FIG. 3 shows a cross sectional view of another embodiment of a smoking article 10 having a tobacco rod 20 with a concentric hollow tube 60 having a heat sink 70 and filter assembly 80. As shown in FIG. 3, the filter assembly 80 has an activated carbon assembly 90 on the upstream side of a segment of filtering material 86. The activated carbon assembly 90 can be comprised of an activated carbon composition 92 mixed with cellulose acetate fibers 94 or other suitable compositions and/or fibers. The filtering material 86 is preferably cellulose acetate; however, other suitable filtering materials can be used.

Figure 4:
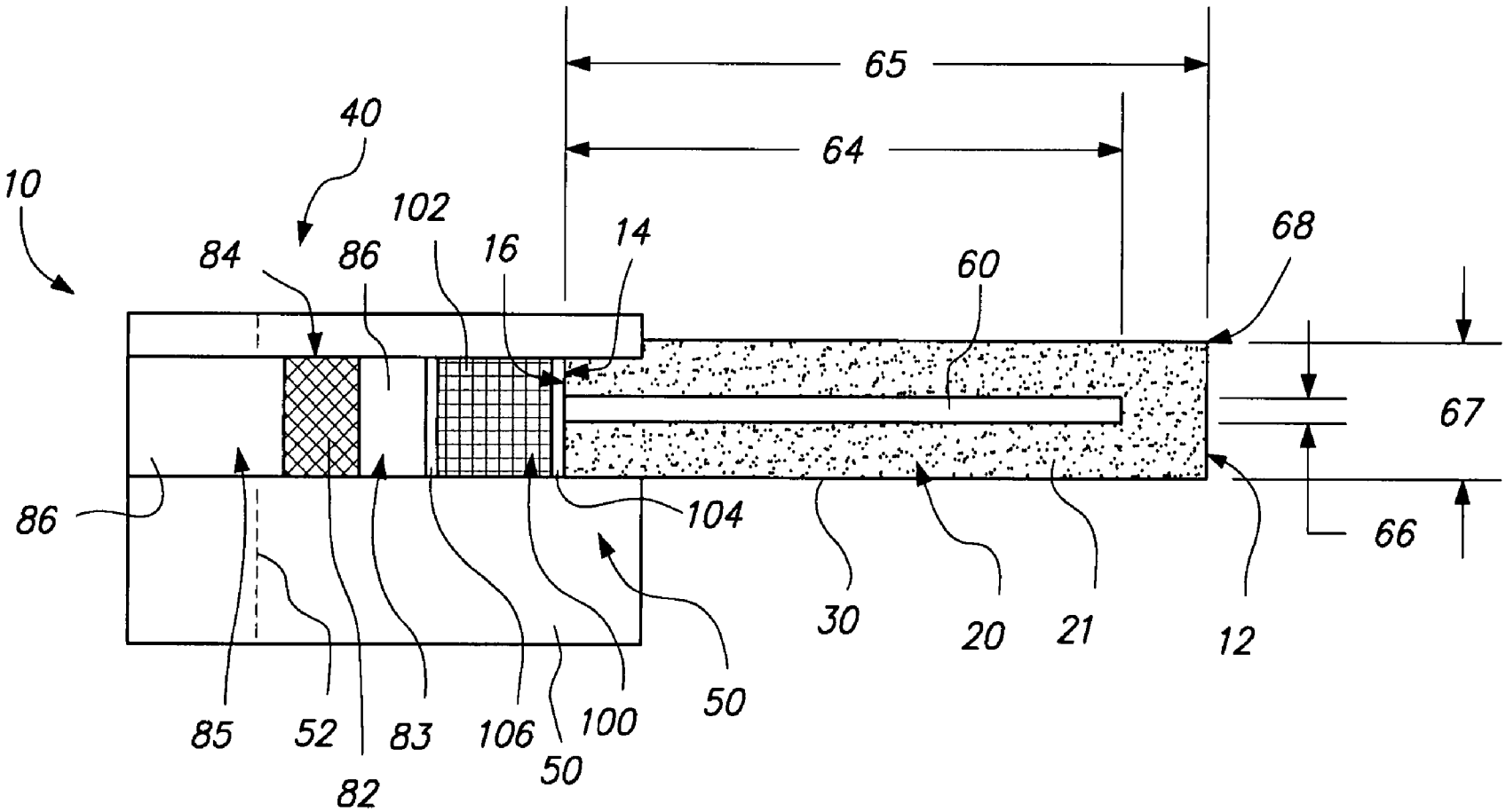
FIG. 4 shows a cross sectional view of a further embodiment of a smoking article having a tobacco rod with a concentric hollow tube and a tipping material, which has been partially unfolded to reveal the filter assembly.
Figure 5:
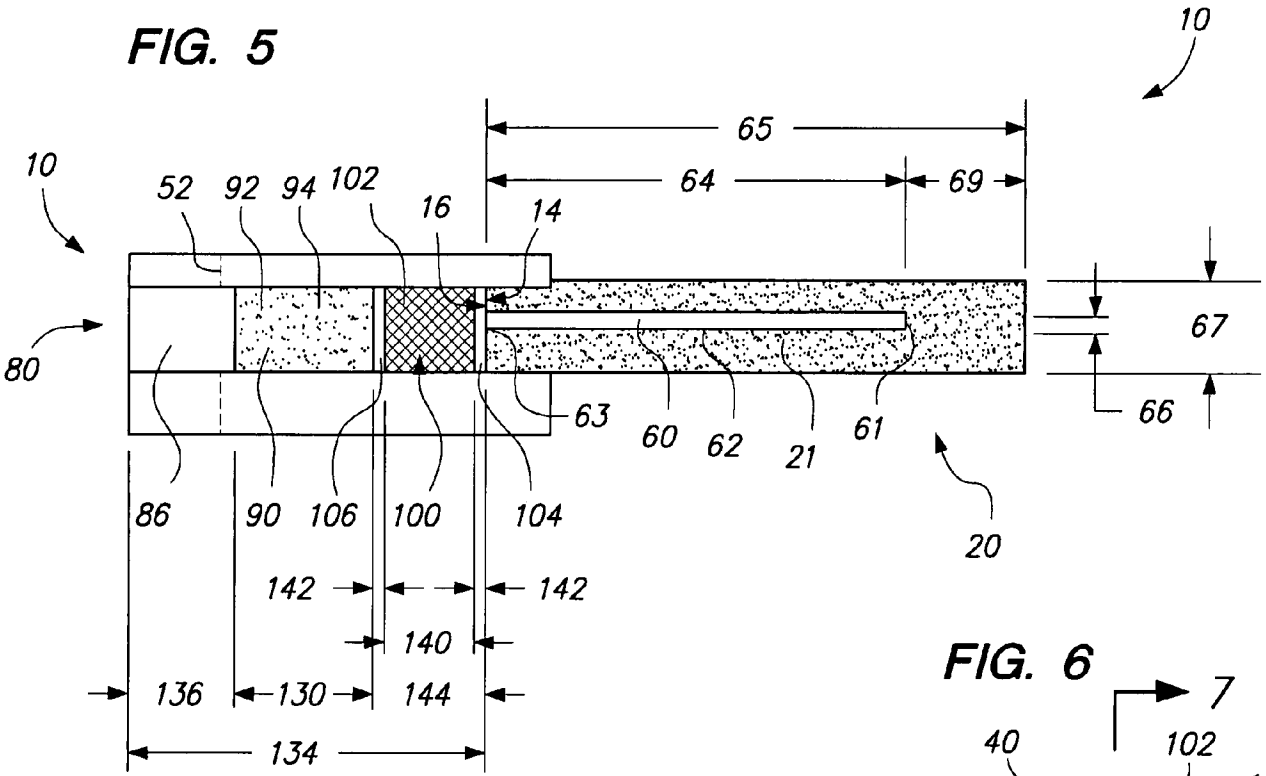
FIG. 5 shows a cross sectional view of another embodiment of a smoking article having a tobacco rod with a concentric hollow tube and a tipping material, which has been partially unfolded to reveal the filter assembly.

As shown in FIG. 3, the filter assembly 80 preferably has a length 134 of about 20.0 to 60.0 millimeters, which is comprised of the activated carbon assembly 90 having a length 130 of about 5.0 to 20.0 mm with the filtering material 86 having a length 136 of about 5.0 to 20.0 mm. Furthermore, the heat sink 70 preferably has a length 132 of about 5.0 to about 20.0 mm. During smoking of the smoking article 10, thermal energy is transported through the hollow portions or tubes 60 of the smoking article 10, which can be dissipated into the heat sink 70 or alternatively utilized to distill an aerosol former 102 within a substrate 100 (FIGS. 4 and 5). The heat sink 70 at the upstream end 16 of the filter system 40 can be a tobacco segment, as shown in FIGS. 2 and 3, or other suitable material including low density porous ceramic segments containing added flavorants and aerosol forming agents. In addition, the smoking article 10 can be provided with an air dilution means, such as a series of ventilation holes or perforations 52, each of which extend through the tipping material 50 and the segment wrap 44 preferably on the downstream side of the carbon assembly 90.

FIG. 4 shows a cross sectional view of a further embodiment of a smoking article 10 having a tobacco rod 20 with a concentric hollow tube 60, and a filter system 40 having a substrate 100 with an aerosol former 102. The substrate 100 acts as a heat sink by dissipating heat from the tobacco rod 20 by evaporation and/or distillation of the aerosol former 102. The substrate 100 containing the aerosol former 102 also preferably has an upstream gap 104 and a downstream gap 106. The upstream and downstream gaps 104, 106 surrounding the substrate 100 prevent the migration of the aerosol former 102 by capillarity to other cigarette components. The upstream and downstream 104, 106 gaps are preferably about 1 to 4 mm and more preferably about 2 mm for a filter system having an overall length of about 5.0 to 20.0 mm.

As shown in FIG. 4, the filter system 40 is comprised of a substrate 100 having an aerosol former 102, and a segment-space-segment or plug-space-plug (PSP) filter configuration comprised of at least one segment of a sorbent material 82 and at least one segment of a filtering material 86. The segment of sorbent material 82 is preferably in the form of an activated carbon filter, which is positioned within a cavity 84 formed of an upstream segment 83 of filtering material 86 and a downstream segment 85 of filtering material 86. The substrate 100 having the aerosol former 102 is positioned on the upstream side of the sorbent material 82. Accordingly, there is an internal gap 106 between the substrate 100 and sorbent material 82 and a gap 104 between the substrate 100 and the tobacco rod 20. The upstream and downstream segments 83, 85 of filtering material 86 are preferably a cellulose acetate or other suitable material.

In use, the heat from the hollow tube 60 distills the aerosol former 102 contained within the substrate 100 by releasing the aerosol former 102 into the mainstream smoke. The aerosol former 102 is preferably a glycerin, propylene glycol, triacetin, propylene carbonate and triethyl citrate or other suitable material and more preferably propylene glycol. It can be appreciated that the substrate 100 for the aerosol former 102 can be made of fibrous materials such as crimped paper, modified celluloses, felts and foams, cross-linked polyacrylamide, hydrogels, or suitable material. Additionally, the substrate 100 containing the aerosol former 102 can be treated with hydrophobic substances such as waxes and paraffin to reduce loss of aerosol former 102 by evaporation during extended storage.

As described herein, the delivery profile of the smoking article 10 including the amount of tar per puff will generally be determined by the length 64 and the internal diameter 66 of the hollow tube 60, as well as its position within the tobacco rod 20. In addition, the amount of tar per puff is also determined by the amount of aerosol former 102 incorporated into the smoke when heat is transferred to the substrate 100 containing aerosol former 102. The amount of aerosol former 102 transferred to the smoke will typically depend on the amount of energy transported to the substrate 100 and the nature of the aerosol former 102. In addition, the amount of energy transferred can also be dependent on the geometry of the hollow tube 60, including the length 64 and internal diameter 66, and position of the hollow tube 60 within the tobacco rod 20, as well as the puff duration and volume.

FIG. 5 shows a cross sectional view of another embodiment of a smoking article 10 having a tobacco rod 20 with a concentric hollow tube 60 and filter assembly 80. The filter assembly 80 has a substrate 100 containing an aerosol former 102, an activated carbon assembly 90 and a segment of filtering material 86 on the downstream side of the carbon assembly 90. The activated carbon assembly 90 is comprised of an activated carbon composition 92 mixed with cellulose acetate fibers 94 or other suitable compositions and fibers. The filtering material 86 is preferably cellulose acetate; however, other suitable filtering materials can be used. As shown in FIG. 5, the substrate 100 containing the aerosol former 102 acts as the heat sink 70 and is preferably on the upstream side of the carbon assembly 90. In addition, the smoking article 10 can include a series of ventilation holes or perforations 52, each of which extend through the tipping material 50 and the segment wrap 44.

FIGS. 6-10 show various cross sectional views of a portion of the filter system 40 as shown in FIGS. 4 and 5 having a substrate 100 containing an aerosol former 102. Since many aerosol formers 102 are volatile enough to evaporate during prolonged storage, it is desirable to prevent the migration of the aerosol former 102 from the heat sink substrate 100 to other cigarettes components, especially to the sorbent material 82. Accordingly, to prevent or limit the migration of the aerosol former 102, the substrate 100 can be encapsulated with an encapsulating material 110 to increase the shelf life of the smoking article 10. The encapsulating material 110 can include gels, polymers, waxes and paraffin for coating and capping, which further can be used to suppress evaporation of the aerosol former 102 during prolonged storage. It can be appreciated that there can be a variety of ways of achieving extended shelf life of the smoking article 10 based on the principle that the encapsulating material 110 can retain the aerosol former 102 more efficiently at room temperature than at the elevated temperatures provided by the hollow tube 60 construction of the smoking article 10. Examples of an encapsulated aerosol former 102 contained in the heat sink 70 portion or substrate 100 of the smoking article 10 are shown in FIGS. 6-10.

Figure 6:
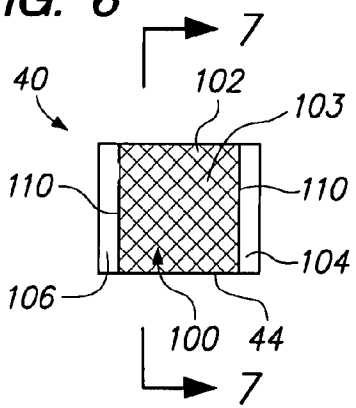
FIG. 6 shows a cross sectional view of another embodiment of a portion of a filter system with a substrate containing an aerosol former as shown in FIGS. 4 and 5.

FIG. 6 shows a cross sectional view of a portion of the filter system 40 including the substrate 100 containing an aerosol former 102 as shown in FIGS. 4 and 5. As shown in FIG. 6, the substrate 100 is comprised of a fibrous heat sink 103 treated with an aerosol former 102. The aerosol former 102 is preferably in a gel form or other suitable form. The substrate 100 is wrapped with an impermeable encapsulating material 110. The impermeable encapsulating material 110 is preferably an aluminized paper or other suitable material. On each side of the substrate 100, the upstream and downstream gap 104, 106 prevents the migration of the aerosol former 102 by capillarity to other cigarette components. In addition, the upstream and downstream gaps 104, 106 equalize the pressure drop between the heat sink 70 and the concentric hollow core tobacco rod 20.

In another embodiment, the substrate 100 is comprised of a fibrous heat sink 103 treated with aerosol former 102 wrapped with an impermeable encapsulating material 110. The impermeable encapsulating material 110 can be an aluminized paper or other suitable material. The impregnated fibers of the fibrous heat sink 103 are top-coated with a wax or a paraffin thin film and includes the upstream and downstream gaps 104, 106, which prevent the migration of the aerosol former 102 by capillarity to other cigarette components and provides an equalized pressure drop between the heat sink 70 and the hollow tube 60 of the tobacco rod 20.

Figure 7:
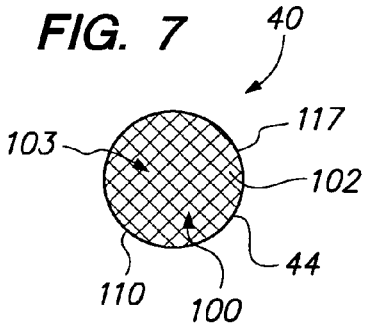
FIG. 7 shows a cross sectional view of the filter system of FIG. 6 along the lines 7-7.

FIG. 7 shows a cross sectional view of the filter system of FIG. 6 along the lines 7-7. As shown in FIG. 7, the substrate 100 having an aerosol former 102 is circumscribed with the encapsulating material 110. The substrate 100 preferably extends to an inner surface 117 of the encapsulating material 110.

Figure 8:
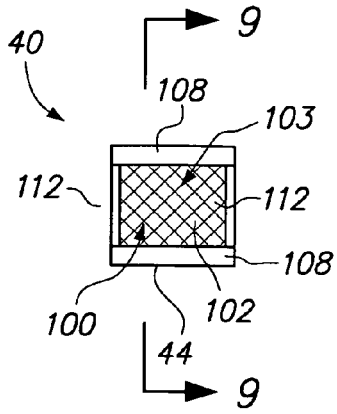
FIG. 8 shows a cross sectional view of another embodiment of a portion of a filter system with a substrate containing an aerosol former.

FIG. 8 shows a cross sectional view of another embodiment of a substrate 100 having an aerosol former 102. As shown in FIG. 8, the substrate 100 is comprised of a fibrous heat sink 103 treated with an aerosol former 102, wrapped with an impermeable encapsulating material 110 such as aluminized paper, housed inside a hollow acetate tube 108. Each end of the substrate 100 is capped with a thin film 112. The thin film 112 is preferably comprised of a material such as wax, paraffin, gum Arabic, alginate film or other thin film material, which is capable of melting at temperatures not greater than 70° C. (158° F.). At smoke temperatures below the melting point of the thin film 112, such as the initial puffs (i.e., puffs 1 to 3), the smoke travels through the hollow acetate tube 108 surrounding the aerosol former substrate 102. As soon as the thin film 112 melts, the hot gases travel through the fibrous heat sink 103 as a result of the fibrous heat sink 103 having a lower pressure drop than the hollow acetate tube 108.

Figure 9:
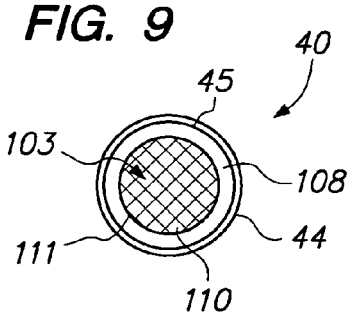
FIG. 9 shows a cross sectional view of the filter system of FIG. 8 along the lines 9-9.

FIG. 9 shows a cross sectional view of the filter system of FIG. 8 along the lines 9-9. As shown in FIG. 9, the substrate 100 containing the aerosol former 102 is circumscribed by the encapsulating material 110. The inner surface 45 of the plug wrap 44 and an outer surface 111 of the encapsulating material 110 forms the hollow acetate tube 108.

Figure 10:
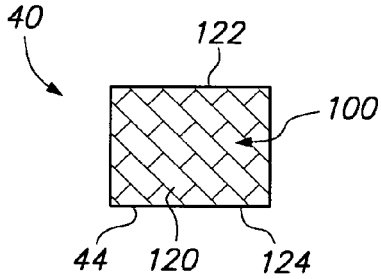
FIG. 10 shows a cross sectional view of another embodiment of a portion of a filter system with a substrate containing an aerosol former.

FIG. 10 shows a cross sectional view of another embodiment of a portion of the filter system 40. As shown in FIG. 10, the substrate 100 is comprised of a super absorbent (SA) polymer 120 such as a crossed-linked polyacrylamide treated with an aerosol former, or its aqueous solution. The super adsorbent polymer 120 can be packed in such a way that the increase in pressure drop in the smoking article 10 is negligible. The super absorbent 120 is preferably housed in a paper tube 122 with impermeable inner walls 124.

Figure 11:
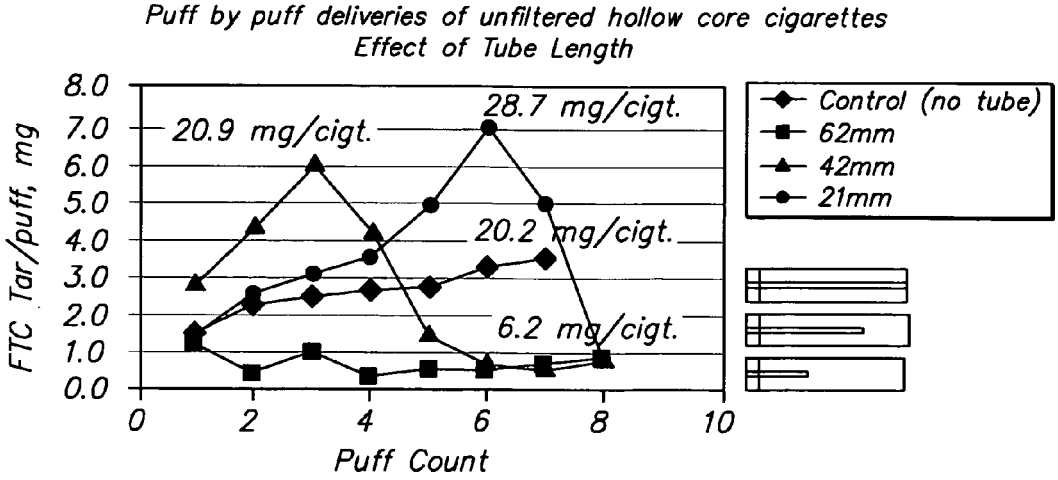
FIG. 11 shows a tar versus puff count for an unfiltered hollow tube smoking article.

FIG. 11 illustrates the difference in TPM per puff, measured by the Federal Trade Commission machine smoking method, for three unfiltered cigarettes containing hollow combustible tubes 60 of different lengths 64. As shown in FIG. 11, hollow tube 60 lengths of 21 millimeters, 42 millimeters, 62 millimeters and a smoking article 10 without a hollow tube 60 were compared for tar per puff, mg versus the number of puffs.

FIG. 5 shows a cross sectional view of a smoking article 10 having a tobacco rod 20 with a concentric hollow tube (or passage) 60 in accordance with another embodiment. The tobacco rod 20 is comprised of a hollow tube 60, surrounded by a smoking material 21, such as a tobacco filler material, and an outer layer of cigarette wrapper (paper) 30. The hollow tube 60 is preferably centrally or concentrically located within the cylindrical rod 20 of smoking material 21, and having a first or upstream end 61 proximate to the lit end 12 of the tobacco rod 20, and a second or downstream end 63 proximate to the tipped end 14 of the tobacco rod 20. As shown in FIG. 5, at the tipped end 14 of the tobacco rod 20, a gap (or cavity) 104 extends from the downstream end 63 of the tobacco rod 20 of the hollow tube 60 to an upstream end 73 of the heat sink 70. The gap 104 preferably has a length 142 of approximately 0.25 to 6 mm, and more preferably a length 142 of approximately 0.5 to 5 mm, and most preferably a length 142 of approximately 1 to 3 mm for a tobacco rod 20 having an overall length 65 of between 20 and 100 mm. During smoking, the gap 104 between the downstream end 63 of the hollow tube 60 and the heat sink 70 creates a path of least resistance for the smoke from the hollow tube 60.

The lit end 12 of the tobacco rod 20 can be fully filled 68 with a smoking material 21, which extends from the lit end 12 of the smoking article 10 to the first or upstream end 61 of the hollow tube 60. The fully filled tip 68 of smoking material 21 provides the smoking article 10 with higher delivery per puff during the initial puffs than subsequent puffs. It can be appreciated that the fully filled tip 68 of smoking material 21 can vary depending on the desired delivery profile and the length 65 of the tobacco rod 20. In use, the heat sink 70 is configured to dissipate the thermal energy transferred from the burning tobacco material 21 (i.e., coal) by the hollow tube 60. The heat sink 70 can be a blended tobacco segment having the same or different character as the smoking material 21 of the tobacco rod 20. Alternatively, the heat sink 70 can be any suitable material including but not limited to tobacco pellets, a low density porous ceramic segment containing added flavors, diluents or other suitable materials.

The filter assembly 80 can be comprised of a heat sink 70 in the form of tobacco or other tobacco filler material and a segment of filtering material 86 preferably in the form of cellulose acetate, or other suitable filtering materials. However, it can be appreciated that the filter assembly 80 can include at least one segment of a sorbent material 82 and at least one segment of a filtering material 86 (FIG. 2), an activate carbon assembly comprised of an activated carbon composition 92 mixed with cellulose acetate fibers 94 or other suitable compositions and/or fibers (FIG. 3), an aerosol former 102 and a "segment-space-segment" or "plug-space-plug" (PSP) filter combination (FIG. 4), an aerosol former 102, an activated carbon assembly and at least one segment of filtering material (FIG. 5), or any combination thereof. In accordance with one embodiment, the smoking article 10 is comprised of a tobacco rod 20 having an overall length 65 of between 50 to 70 mm, a tobacco heat sink 70 having a length of about 6 to 10 mm, a gap 140 of 1 to 3 mm between the downstream end 63 of the hollow tube 60 and an upstream end 73 of the heat sink 70, and a segment of filtering material 86 in the form of cellulose acetate plug of 14 to 20 mm.

It will be understood that the foregoing description is of the preferred embodiments, and is, therefore, merely representative of the article and methods of manufacturing the same. It can be appreciated that many variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A smoking article comprising:

a cylinder of smoking material;

a hollow tube within the cylinder of smoking material;

a heat sink at a downstream end of the hollow tube the heat sink including an aerosol former;

a filter system attached to the heat sink, the filtering system comprising an upstream segment of filtering material and a downstream segment of filtering material in a spaced-apart relationship, and a sorbent material positioned between the upstream and the downstream segments of filtering material; and a gap between the downstream end of the hollow tube and the heat sink, wherein the upstream and the downstream segments of filtering material are cellulose acetate tow and the aerosol former is selected from a group consisting of glycerin, propylene glycol, triacetin, propylene carbonate and triethyl, and wherein the heat sink is a segment of smoking material, and the heat sink is wrapped with an impermeable encapsulating material and wherein each end of the heat sink is capped with a thin film, which melts upon exposure to heat.

2. The smoking article of claim 1, wherein the sorbent material is an activated carbon material.

3. The smoking article of claim 2, wherein the activated carbon material comprises an activated carbon composition mixed with cellulose acetate fibers.

4. The smoking article of claim 1, wherein the upstream segment of filtering material is a segment of cellulose acetate tow on an upstream side of the sorbent material.

5. A smoking article comprising:

a cylinder of smoking material;

a hollow tube within the cylinder of smoking material;

a heat sink at a downstream end of the hollow tube; and a filter system attached to the heat sink, the filtering system comprising an upstream segment of filtering material and a downstream segment of filtering material in a spaced-apart relationship, and a sorbent material positioned between the upstream and the downstream segments of filtering material, wherein the heat sink is a segment of smoking material containing an aerosol former and wherein the upstream and the downstream segments of filtering material are cellulose acetate tow and the aerosol former is selected from a group consisting of glycerin, propylene glycol, triacetin, propylene carbonate and triethyl, and the heat sink is wrapped with an impermeable encapsulating material and wherein each end of the heat sink is capped with a thin film, which melts upon exposure to heat.

6. The smoking article of claim 5, wherein heat from the hollow tube distills the aerosol former.

7. The smoking article of claim 5, wherein the aerosol former is encapsulated within an impermeable material.

8. The smoking articles of claim 1, wherein the hollow tube has an inner diameter of about 2.0 to 3.0 millimeters.

9. The smoking article of claim 1, further comprising smoking material between an upstream end of the hollow tube and an upstream end of the cylinder of smoking material.

10. The smoking article of claim 1, wherein heat is convectively transferred with smoke from a lit end of the cylinder of smoking material through the hollow tube to a mouth end of the cylinder of smoking material in each puff.

11. The smoking article of claim 1, wherein the sorbent material has an upstream air gap and a downstream air gap between the upstream segment of filtering material and the downstream segment of filtering material.

12. A smoking article comprising:

a tobacco rod ignitable to form a coal;

a filter in cooperative relation with said tobacco rod, the filter comprising a heat sink having an aerosol former, an upstream segment and a downstream segment of cellulose acetate in a spaced-apart relationship, and a sorbent material located between the upstream and the downstream segments of cellulose acetate;

said tobacco rod comprising:

a fully filled rod portion adjacent a free end of said tobacco rod; and a hollow, partially filled, rod portion located between said free end and said filter;

such that tar delivery per puff is reduced as a coal progresses from said fully filled rod portion into said hollow, partially filled, rod wherein the upstream and the downstream segments of filtering material are cellulose acetate tow and the aerosol former is selected from a group consisting of glycerin, propylene glycol, triacetin, propylene carbonate and triethyl, and the heat sink is wrapped with an impermeable encapsulating material and wherein each end of the heat sink is capped with a thin film, which melts upon exposure to heat.

13. A method of making a smoking article, comprising:

forming a tobacco rod portion of the smoking article by placing smoking material between a hollow tube and an outer layer of wrapper paper;

forming a filter system of the smoking article having a plurality of segments comprising a heat sink segment, a pair of filtering material segments in a spaced apart relationship, and a sorbent material located between the pair of filtering material segments; and joining said tobacco rod portion in end-to-end relationship with the filter system, wherein said heat sink segment comprises an aerosol former, wherein the upstream and the downstream segments of filtering material are cellulose acetate tow and the aerosol former is selected from a group consisting of glycerin, propylene glycol, triacetin, propylene carbonate and triethyl, and wherein the heat sink is a segment of smoking material, and the heat sink is wrapped with an impermeable encapsulating material and wherein each end of the heat sink is capped with a thin film, which melts upon exposure to heat.

14. A method of generating from a smoking article a smoke of enhanced perceived strength by altering the puff count profile of the smoking article to have stronger per puff delivery along one or more first puffs by spacing a hollow tobacco rod portion in a spaced relation away from a fully filled tip portion of the smoking article and joining a filter segment to the hollow tobacco rod portion having a plurality of segments comprising a heat sink segment, a pair of filtering material segments in a spaced-apart relationship, a sorbent material located between the pair of filtering material segments; and a gap between a downstream end of the hollow tobacco rod portion and the heat sink segment and wherein the upstream and the downstream segments of filtering material are cellulose acetate tow and the aerosol former is selected from a group consisting of glycerin, propylene glycol, triacetin, propylene carbonate and triethyl, wherein the heat sink is a segment of smoking material, and the heat sink is wrapped with an impermeable encapsulating material and wherein each end of the heat sink is capped with a thin film, which melts upon exposure to heat.

* * * * *